US010842273B2

(12) United States Patent
Fei et al.

(10) Patent No.: US 10,842,273 B2
(45) Date of Patent: Nov. 24, 2020

(54) MECHANICAL LINKAGE STRUCTURE FOR LINKING CHAIR AND SEAT, FRAME AND CHAIR HAVING THE MECHANICAL LINKAGE STRUCTURE

(71) Applicant: HAINING MY HOME MECHANISM CO., LTD., Haining (CN)

(72) Inventors: Zhongqiang Fei, Haining (CN); Xiqi Sun, Haining (CN); Shaoqiang Fei, Haining (CN)

(73) Assignee: HAINING MY HOME MECHANISM CO., LTD., Haining (CN)

( * ) Notice: Subject to any disclaimer, the term of this patent is extended or adjusted under 35 U.S.C. 154(b) by 0 days.

(21) Appl. No.: 16/398,268

(22) Filed: Apr. 30, 2019

(65) Prior Publication Data

US 2019/0357681 A1 Nov. 28, 2019

(30) Foreign Application Priority Data

May 25, 2018 (CN) ..... 2018 2 0795580 U

(51) Int. Cl.

| | |
|---|---|
| ***A47C 1/032*** | (2006.01) |
| ***A47C 7/50*** | (2006.01) |
| ***A47C 1/037*** | (2006.01) |

(52) U.S. Cl.

CPC ..... *A47C 1/032* (2013.01); *A47C 1/037* (2013.01); *A47C 7/5062* (2018.08)

(58) Field of Classification Search

CPC ..... A47C 1/032; A47C 7/5062; A47C 1/037
USPC ..... 297/89
See application file for complete search history.

(56) References Cited

U.S. PATENT DOCUMENTS 5,582,457 A * 12/1996 Komorowski ..... A47C 1/0345 297/423.35
2011/0198894 A1* 8/2011 Hsieh ..... A47C 1/0345 297/68

* cited by examiner

*Primary Examiner* — Anthony D Barfield

(57) ABSTRACT

A mechanical linkage structure for linking a chair and a seat, comprises a first link, a second link, and a third link respectively used as a driven link, a fourth link used as a driving link, a fifth link, a sixth link, and a seventh link respectively used as a driven link. The first link is pivotally connected to the second link and the third link, respectively; the second link is pivotally connected to the fourth link and the fifth link, respectively; the third link is pivotally connected to the fourth link, the fifth link, and the seventh link, respectively; the fifth link is pivotally connected to the sixth link; the sixth link is pivotally connected to the seventh link; the fourth link is driven to rotate the first link, the second link, the third link, the fifth link, the sixth link and the seventh link, to realize the unfolding or collapse of the mechanical linkage structure.

12 Claims, 9 Drawing Sheets

MECHANICAL LINKAGE STRUCTURE FOR LINKING CHAIR AND SEAT, FRAME AND CHAIR HAVING THE MECHANICAL LINKAGE STRUCTURE

CROSS REFERENCE TO RELATED APPLICATIONS

This application claims all benefits accruing under 35 U.S.C. § 119 from China Patent Application No. 201820795580.1, filed on May 25, 2018 in the State Intellectual Property Office of China, the content of which is hereby incorporated by reference.

TECHNICAL FIELD

The present disclosure relates to chairs, and in particular, to a mechanical linkage structure for linking a chair and seat, and further to a frame and a chair having the mechanical linkage structure.

BACKGROUND

A folding deck chair sometimes include a cushion for support and comfort. When the chair is in a folded state, the chair cushion extends from a seat portion of the chair, along a front surface of the chair to form an extended seat. When the seat is unfolded, the cushion is continuous to the seat portion and extends outwardly from the seat portion. It is further expected to have an additional support portion for a leg or foot, which extends beyond the cushion. The additional support portion for the leg or foot is assembled to the chair, which can be unfolded and folded relative to the chair.

A multi-link mechanism is generally used to realize the unfolding and folding of the seat part. However, as far as the current situation is concerned, the existing linkage mechanical linkage structure has a complicated structure and poor stability, and cannot meet some requirements.

SUMMARY

Therefore, it is necessary to provide a mechanical linkage structure for linking chair and seat, a frame having the mechanical linkage structure, and a chair thereof, to be simple in structure and stable operation.

For An embodiment of the present disclosure includes a mechanical linkage structure for linking chair and seat, comprising a first link, a second link, and a third link respectively used as a driven link, a fourth link used as a driving link, a fifth link, a sixth link, and a seventh link respectively used as another driven link. The first link is pivotally connected to the second link and the third link, respectively; the second link is pivotally connected to the fourth link and the fifth link, respectively; the third link is pivotally connected to the fourth link, the fifth link, and the seventh link, respectively; the fifth link is pivotally connected to the sixth link; the sixth link is pivotally connected to the seventh link; the fourth link is driven to rotate the first link, the second link, the third link, the fifth link, the sixth link and the seventh link, to realize unfolding or collapsing of the mechanical linkage structure.

The first link, the second link, the third link, the fourth link, the fifth link, the sixth link and the seventh link respectively comprises a plurality of pivoting points thereon, which are used to realize direct or indirect pivotal connection between the first link, the second link, the third link, the fourth link, the fifth link, the sixth link, and the seventh link.

A lying cushion connection platform is disposed on the fourth link, and a front cushion connection platform is disposed on the seventh link. When the mechanical linkage structure is unfolded, the front cushion connection platform is flush with the lying cushion connection platform in a horizontal direction. When the mechanical linkage structure is folded, the front cushion connection platform is flush with the lying cushion connection platform in a vertical direction.

The fourth link is in a "V" shape, an "L" shape, or an arc shape.

The mechanical linkage structure further comprises a limit mechanism for restricting the movement of the fifth link, so that the seventh link moves along a predetermined trajectory while being collapsed or unfolded.

Preferably, the limit mechanism comprises an engaging portion disposed on the second link, and a limiting slot disposed on the fifth link, the engaging portion is mounted in the limiting slot, and the engaging portion moves along the limiting slot during the being collapsed or unfolded of the mechanical linkage structure.

Preferably, the mechanical linkage structure further comprises a tensioning mechanism configured to make the lying cushion connection platform and the front cushion connection platform flush with each other in a vertical direction when the mechanical linkage structure is in a collapsed state.

Preferably, the tensioning mechanism comprises an elastic member, one end of the elastic member is connected to the fifth link, and the other end of the elastic member is connected the seventh link.

Preferably, a limiting member is disposed on the seventh link and is configured to limit the movement trajectory of the fourth link, the sixth link, and the seventh link.

The present disclosure further provides a frame, comprises a fixing assembly, a movable link assembly coupled to the fixing assembly, and the mechanical linkage structure pivotably connected to the movable link assembly.

The present disclosure further provides a chair comprising the frame above.

In the mechanical linkage structure for linking chair and seat, the frame and the chair having the mechanical linkage structure thereof, the fourth link is pivotally connected to the second link and the third link, the fifth link is pivotally connected to the second link, the third link, and the sixth link, the seventh link is pivotally connected to the third link and the sixth link. Therefore, the first link, the second link, the third link, the fifth link, the sixth link, and the seventh link are respectively rotated, by driving the fourth link, to realize the unfolding or folding of the mechanical linkage structure.

DETAILED DESCRIPTION

The technical solutions in the embodiments of the present disclosure are clearly and completely described in the following with reference to the accompanying drawings in the embodiments of the present disclosure. It is obvious that the described embodiments are only a part of the embodiments, but not all of the embodiments. All other embodiments obtained by those skilled in the art based on the embodiments of the present disclosure without departing from the inventive scope are the scope of the disclosure.

It should be noted that when an element is referred to as being "assembled on" another element, it may be directly or indirectly disposed on another element. When an element is considered to be "fixed" to another element, it may be directly or indirectly attached to another element.

All technical and scientific terms used herein have the same meaning as commonly understood by one of ordinary skill in the art to which this disclosure is claimed. The terminology used in the description herein is for the purpose of describing particular embodiments, and is not intended to limit the disclosure. The term "or/and" as used herein includes any and all combinations of one or more of the associated listed items.

Figure 1:
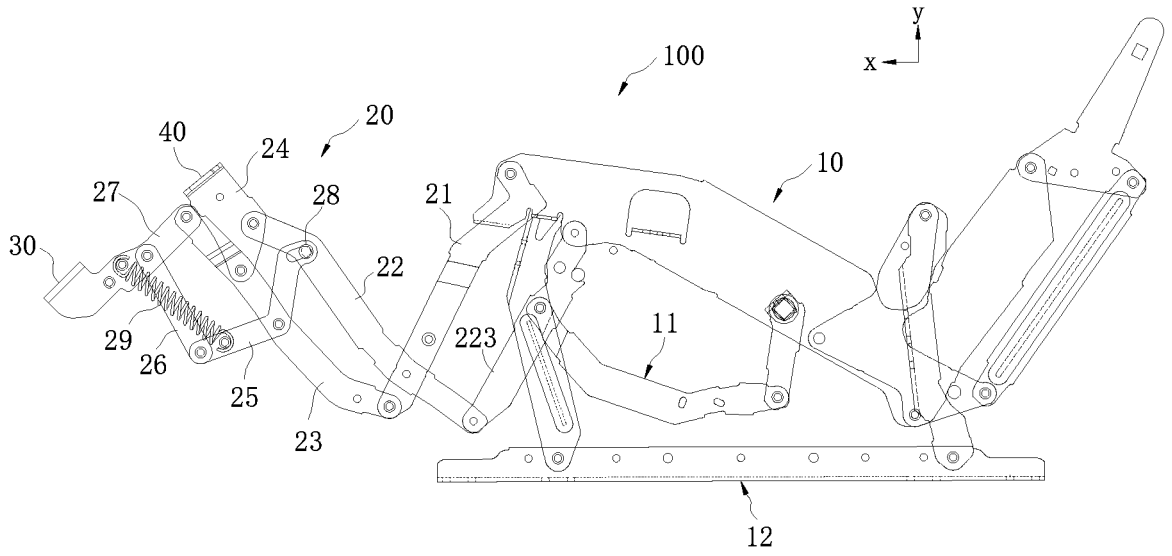
FIG. 1 is a schematic view of a frame of a chair provided by the present disclosure.

Referring to FIG. 1, a frame 100 according to an embodiment of the present disclosure is illustrated. The frame 100 may be used for a deck chair. It may be understood that the frame 100 is not limited to be applied to a deck chair, and may be applied to, for example, a smart chair frame and a seat frame.

The frame 100 includes a main bracket 10 which is telescopically adjustable and configured for support, and a mechanical linkage structure 20 for linking chair and seat which is also telescopically adjustable and configured for support. The main bracket 10 and the mechanical linkage structure 20 are pivotally connected to each other. The mechanical linkage structure 20 is received in the main bracket 10, and is movable relative to the main bracket 10 to realize the unfolding and folding operation of the mechanical linkage structure 20.

The main bracket 10 is provided with a lying cushion for a user to rest, a front cushion, and a seat for a backrest (not shown), etc. The main bracket 10 includes a movable link assembly 11 with a plurality of movable links which are pivotally connected to each other and telescopically adjustable, and a fixing link assembly 12 with a plurality of fixed links fixed to each other for supporting and connecting to the movable link assembly 11. The movable link assembly 11 is pivotally connected to the mechanical linkage structure 20. By adjusting the movable link assembly 11 and the mechanical linkage structure 20, the mechanical linkage structure 20 is unfolded and collapsed/folded relative to the main bracket 10.

Furthermore, the main bracket 10 is further provided with a driving portion (not shown) for driving the mechanical linkage structure 20 to be unfolded or collapsed. It should be understood that the driving portion (not shown) may be an electronically controlled driving structure or a manual driving structure. The specific driving structure (not shown) may be set according to actual needs.

In the present embodiment, the structure of the main bracket 10 is not a key point in the present disclosure. Therefore, the specific structure of the main bracket 10 will not be further described herein.

Figure 2:
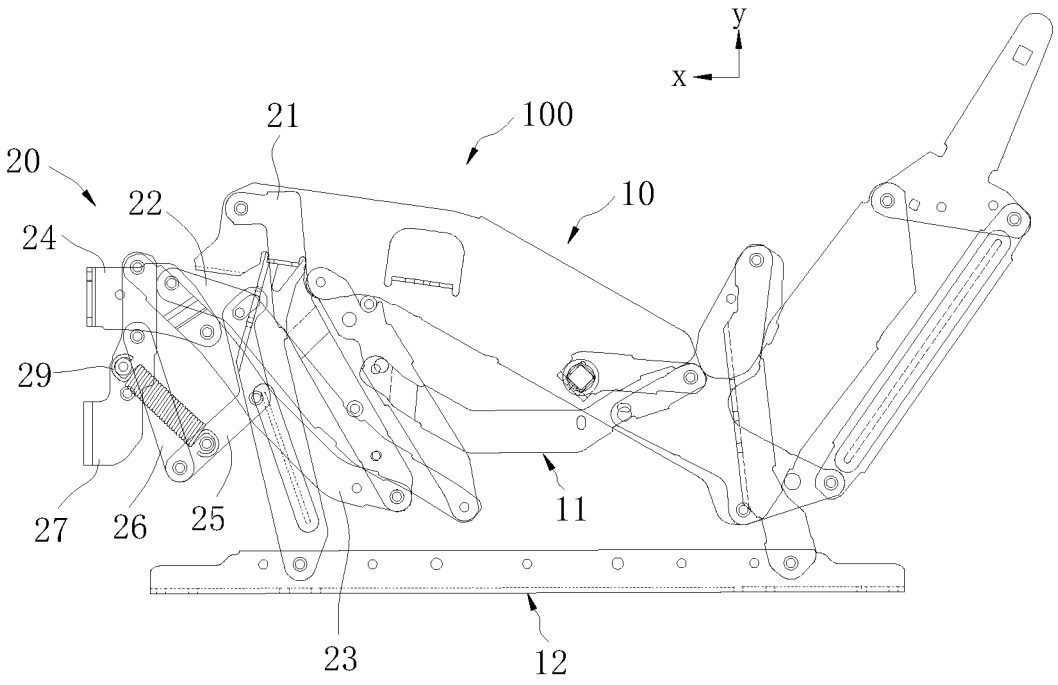
FIG. 2 is a side view showing a mechanical linkage structure of the frame of FIG. 1, in a folded state.

Further referring to FIG. 1 and FIG. 2, the mechanical linkage structure 20 is provided with a front cushion connection platform 30 and a lying cushion connection platform 40. When the mechanical linkage structure 20 is unfolded relative to the main bracket 10, the front cushion connection platform 30, the lying cushion connection platform 40 and the lying cushion are substantially in parallel so that the user may completely lie down thereon. When the mechanical linkage structure 20 is folded relative to the main bracket 10, the mechanical linkage structure 20 abuts against the main bracket 10, and the lying cushion is used for the user in a semi-recumbent state to lay legs thereon.

Figure 3:
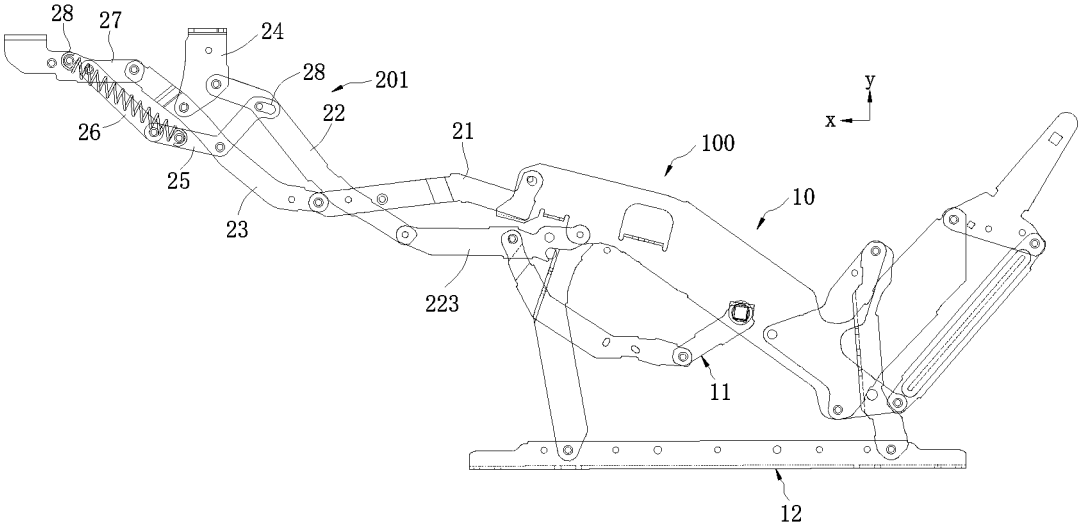
FIG. 3 is a side view showing the mechanical linkage structure of FIG. 2, in an unfolded state.

The mechanical linkage structure 20 includes a series of interconnected links that control the extension and retraction of the mechanical linkage structure 20 from the folded state shown in FIG. 2 to the unfolded state shown in FIG. 3. It should be understood that although only one of the mechanical linkage structures 20 is illustrated in the drawings, one or more of the mechanical linkage structure 20 may be present on the frame 100, each of which is substantially a mirror structure to the other one, while the structure thereof is substantially the same, and are arranged symmetrically about a plane (e.g., y-plane) in a vertical direction that bisects the frame 100. Thus, the ensuing discussion will be directed to only one of the mechanical linkage structures 20, the contents of which may equally be applied to another mirror mechanical linkage structure 20 or other mechanical linkage structures 20.

It should be understood and appreciated that the elements of the mechanical linkage structure 20 discussed herein may be made of any suitable material known in the furniture industry, such as metal (e.g. steel formed by stamping) for brackets, panels, and links. Moreover, it should be understood and appreciated that the elements may be joined together using any technology or mechanism known in the furniture manufacturing industry. For example, elements may be rigidly connected by rivets, bolts, welding, and the like. Additionally, the shapes of the elements described herein, as well as the connections or attachment points between the elements, may vary.

Referring to FIG. 3, the mechanical linkage structure 20 includes a first link 21, a second link 22, a third link 23, a fourth link 24, a fifth link 25, a sixth link 26, and a seventh links 27. The first link 21, the second link 22, the third link 23, the fourth link 24, the fifth link 25, the sixth link 26, and the seventh link 27 are directly or indirectly pivoted to each other, to enable the mechanical linkage structure 20 to be adjusted for unfolding and folding.

Further, the first link 21 and the second link 22 and the third link 23 are pivotally connected to each other. The second link 22 is pivotally connected to the fourth link 24 and the fifth link 25. The third link 23 is pivotally connected to the first link 21, the fourth link 24, the fifth link 25, and the seventh link 27. The fifth link 25 is pivotally connected to the second link 22, the third link 23, and the sixth link 26. The sixth link 26 is pivotally connected to the fifth link 25 and the seventh link 27. Thus, the direct or indirect pivotal connection between the first link 21, the second link 22, the third link 23, the fourth link 24, the fifth link 25, the sixth link 26 and the seventh link 27 is realized through the respective pivotal connection between the respective links, to further realize mutual movements between the respective links, so that the mechanical linkage structure 20 may be adjusted to be unfolded or folded.

It should be understood and appreciated that the direct pivotal connection refers to, for example, the first link 21 directly connected to the second link 22 with a pivotal connection, etc. The indirect pivotal connection refers to, for example, the fifth link 25 and the first link 21 are bridged by the second link 22 or the third link 23, and the way of achieving the connection between the link 25 and the first link 21 or the like is referred to as the indirect pivotal connection.

Figure 4:
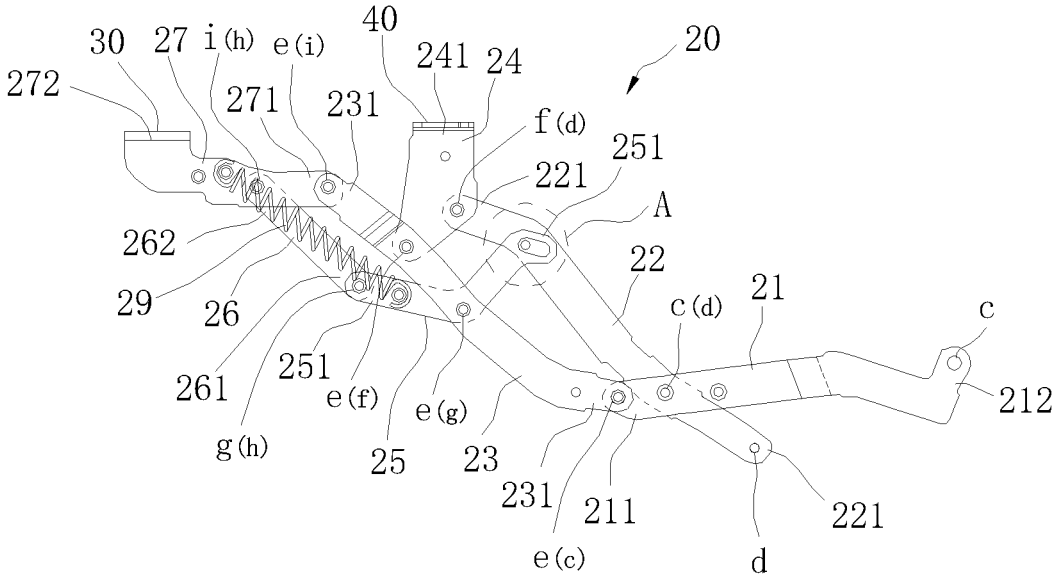
FIG. 4 is another side view of the mechanical linkage structure of FIG. 2, according to an embodiment of the present disclosure.
Figure 5:
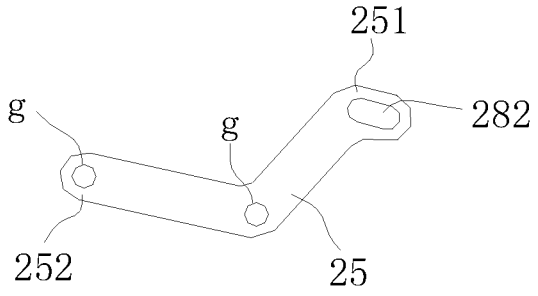
FIG. 5 is a partial enlarged view of circled portion V shown in FIG. 4.

Specifically, referring to FIG. 4 and FIG. 5, the first link 21 is used as a driven link, and includes a first end 211 and a second end 212 disposed opposite to each other, the first end 211 is pivotally connected to the movable link assembly 11, and the second end 212 is pivotally connected to the third link 23. The second link 22 is used as a driven link, and includes a first end 221 pivotally connected to the movable link assembly 11 and a second end 222 pivotally connected to the fourth link 24. The third link 23 is used as a driven link, and includes a first end 231 and a second end 232 disposed opposite to each other, the first end 231 is pivotally connected to the second end 212 of the first link 21, and the second end 232 is pivotally connected to the seventh link 27. The fourth link 24 is used as a driving link, that is, a driving member, includes a first end 241 and a second end 242 disposed opposite to each other, the first end 241 is pivotally connected to the third link 23, and the second end 242 is configured for mounting the lying cushion platform 40. The fifth link 25 is used as a driving link, and includes a first end 251 and a second end 252 disposed opposite to each other, and the first end 251 is pivotally connected to the second link 22, the second end 252 is pivotally connected to the sixth link 26. The sixth link 26 is used as a driven link, and includes a first end 261 and a second end 262 disposed opposite to each other, the first end 261 is pivotally connected to the second end 252 of the fifth link 25, and the second end 262 is pivotally connected to the seventh link 27. The seventh link 27 is used as a driven link, includes a first end 271 and a second end 272 oppositely disposed to each other, the first end 271 is pivotally connected to the second end 232 of the third link 23, and the second end 272 is configured for mounting the front cushion connection platform 30.

It may be understood that the direct or indirect pivotal connection between the first link 21, the second link 22, the third link 23, the fourth link 24, the fifth link 25, the sixth link 26 and the seventh link 27 is realized through the pivotal connection between the links, to further realize mutual movements between the respective links, so that the mechanical linkage structure 20 may be adjusted to unfold or fold.

It may be understood that the first end 211 of the first link 21 and the first end 221 of the second link 22 may be respectively connected to other links, such that the first link 21 and the second link 22 is pivotally connected to the movable link assembly 11, respectively, through the other links. In the present embodiment, the first end 211 of the first link 21 is directly pivotally connected to the movable link assembly 11. The first end 221 of the second link 22 is pivotally connected with a connecting rod 223, and the pivotal connection with the movable link assembly 11 is realized by the connecting rod 223.

The first link 21 includes a plurality of pivot points c. Specifically, on the first end 211, the second end 212, and the portion nearby the second end 212 of the first link 21 are respectively provided with the pivot point c. An intersection 21*a* of the first end 211 of the first link 21 is pivotally connected to the movable link assembly 11. The pivot point c of the second end 212 of the first link 21 is pivotally connected to the first end 231 of the third link 23. The pivot point c of the first link 21 adjacent to the second end 212 of the first link 21 is used for a pivotal connection with the second link 22.

The second link 22 includes a plurality of pivot points d thereon. Specifically, on the first end 221 of the second link 22, the portion adjacent to the first end 221, and the second end 222 are respectively provided with the pivot point d. The pivot point d of the first end 221 of the second link 22 is used for a pivotal connection with the movable link assembly 11. The pivotal point d of the second link adjacent to the first end 221 is configured to cooperate with the pivot point c of the first link 21 adjacent to the second end 212 of the first link 21, to realize a pivotal connection between the second link 22 and the first link 21. The pivot point d of the second end 222 of the second link 22 is used for a pivotal connection with the fourth link 24.

It may be understood that the pivot point d of the second link 22 adjacent to the first end 221 is at the same position with the pivot point c of the first link 21 adjacent to the second end 212 of the first link 21.

The third link 23 includes a plurality of pivot points e thereon. Specifically, on the first end 231, the second end 232, and the portion adjacent to the second end 232 of the third link 23, and the middle of the third link 23 respectively includes the pivot point e. The pivot point e of the first end 231 of the third link 23 is used to cooperate with the pivot point c of the second end 212 of the first link 21, to realize the pivotal connection between the third link 23 and the first link 21. The pivot point e in the middle of the third link 23 is used for a pivotal connection with the fifth link 25. The pivot point e of the second end 232 of the third link 23 is used for a pivotal connection with the seventh link 27. The pivot point e of the third link 23 adjacent to the second end 232 is configured for a pivotal connection with the fourth link 24.

It may be understood that the pivot point e of the first end 231 of the third link 23 is at the same position as the pivot point c of the second end 212 of the first link 21.

The fourth link 24 includes a plurality of pivot points f thereon. Specifically, the pivot points f are respectively disposed on the first end 241 of the fourth link 24 and adjacent to the first end 241. The pivot point f on the first end 241 of the fourth link 24 is used to cooperate with the pivot point e of the third link 23 adjacent to the second end 232 to realize the pivotal connection between the third link 23 and the fourth link 24. The pivot point f on the fourth link 24 adjacent to the first end 241 is configured to cooperate with the pivot point d on the second end 222 of the second link 22 to realize the pivotal connection between the fourth link 24 and the second link 22.

It may be understood that the pivot point f on the first end 241 of the fourth link 24 is at the same position as the pivot point e of the third link 23 adjacent to the second end 232.

The fifth link 25 can be substantially in a V-shape. In other embodiments, the fifth link 25 may be in an L-shape, an arc shape, or the like. The fifth link 25 may also be composed of a plurality of sub-links.

The fifth link 25 includes a plurality of pivot points g thereon. Specifically, pivot points g may be disposed in the middle portion of the fifth link 25 and on the second end 252 of the fifth link 25, respectively. The first end 251 of the fifth link 25 is pivotally connected to the second link 22. The pivot point g in the middle portion of the fifth link 25 cooperates with the pivot point e in the middle portion of the third link 23 to realize a pivotal connection between the fifth link 25 and the third link 23. The pivot point g of the second end 252 of the fifth link 25 is used for pivotal connection with the sixth link 26.

It may be understood that the pivot point g in the middle portion of the fifth link 25 is located at the same position as the pivot point e in the middle portion of the third link 23.

The sixth link 26 includes a plurality of pivot points h thereon. Specifically, the pivot points h are disposed on the first end 261 of the sixth link 26 and the second end 262 of the sixth link, respectively. The pivot point h of the first end 261 of the sixth link 26 is used to cooperate with the pivot point g of the second end 252 of the fifth link 25 to realize the pivotal connection between the sixth link 26 and the fifth link 25. A pivot point h on the second end 262 of the sixth link 26 is used for pivotal connection with the seventh link 27.

It may be understood that the pivot point h of the first end 261 of the sixth link is at the same position as the pivot point g of the second end 252 of the fifth link 25.

The seventh link 27 includes a plurality of pivot points i thereon. Specifically, the pivot points i are disposed on the first end 271 of the seventh link 27 and the portion adjacent to the first end 271. The pivot point i on the first end 271 of the seventh link 27 is used to cooperate with the pivot point e on the second end 232 of the third link 23 to realize a pivotal connection between the seventh link 27 and the third link 23. The pivot point i adjacent to the first end 271 of the seventh link 27 is configured to cooperate with the pivot point h on the second end 262 of the sixth link 26 to realize the pivotal connection between the seventh link 27 and the sixth links 26.

It may be understood that the pivot point i on the first end 271 of the seventh link is at the same position as the pivot point e on the second end 232 of the third link 23. The pivot point i of the seventh link 27 adjacent to the first end 271 is located at the same position as the pivot point h on the second end 262 of the sixth link 26.

It should be understood and appreciated that the direct or indirect pivotal connection between the first link 21, the second link 22, the third link 23, the fourth link 24, the fifth link 25, the sixth link 26, and the seventh link 27 are realized through the pivot points on the respective links described above.

In other embodiments, the mechanical linkage structure 20 may also include other links. It should be understood and appreciated that the added links would not interfere with the basic pivotal connection between the first link 21, the second link 22, the third link 23, the fourth link 24, the fifth link 25, the sixth link 26, and the seventh link 27, and would be also configured to achieve a function of unfolding and collapsing of the mechanical linkage structure 20.

It should be understood and appreciated that the pivotal connection between the above-described mechanical linkage structure 20 may take various configurations, such as pivot pins, bearings, conventional mounting assemblies, rivets, a combination of bolts and nuts, or any other suitable fasteners known in the furniture industry. In addition, the shape of the linkage structure and the frame may be varied, such as the location of particular pivots and/or pivot point. It should be understood that when the linkage structure is referred to as being pivotally "coupled," "connected," "interconnected," "attached," etc. to another element (e.g., linkage, bracket, frame, etc.), the linkage structure and elements may be in direct contact with each other, or connected through other elements, such as intermediate elements.

In this embodiment, the first link 21, the second link 22, the third link 23, the fourth link 24, the fifth link 25, the sixth link 26 and the seventh link 27 constitute several four-link units 201, to make the mechanical linkage structure 20 smoother during the process of unfolding, semi-folding or folding, and the support is more stable. Specifically, the first link 21, the second link 22, the third link 23 and the fifth link 25 form a four-link unit 201; the second link 22, the third link 23, the fourth link 24, and the fifth link 25 form another four-link unit 201; the third link 23, the fifth link 25, the sixth link 26 and the seventh link 27 form another four-link unit 201. A couple of the four-link units 201 are pivotally coupled to each other to effect unfolding, semi-folding or folding of the mechanical linkage structure 20.

Figure 6:
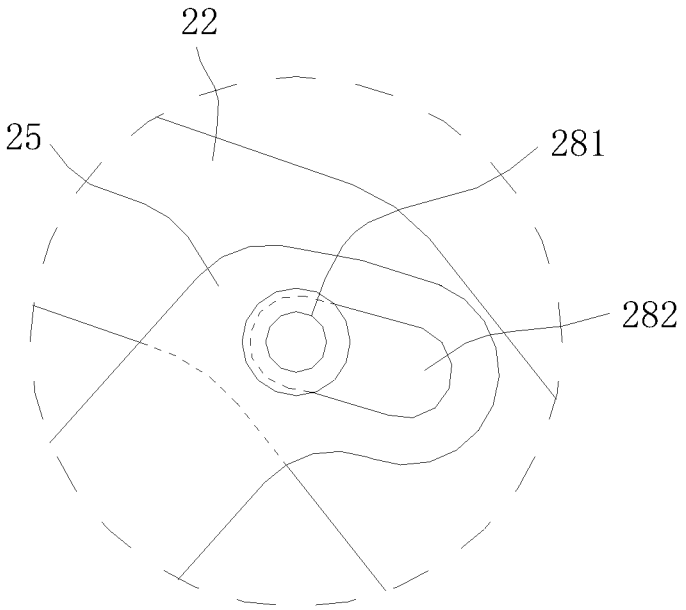
FIG. 6 is a side view of a limit mechanism provided by the present disclosure.
Figure 7:
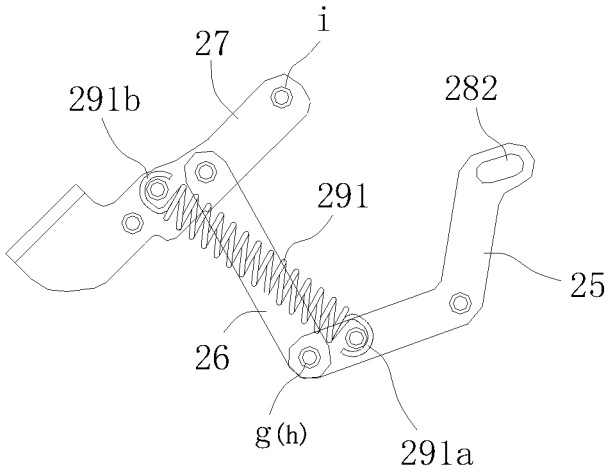
FIG. 7 is a side view of a fifth link provided in the present disclosure.

Referring to FIG. 1, FIG. 5 and FIG. 6, the mechanical linkage structure 20 further includes a limit mechanism 28 for limiting movement of the fifth link 25 and a tensioning mechanism 29 configured to cause a pulling force on the seventh link 27.

In the present embodiment, when the mechanical linkage structure 20 is in the collapsed/folded state, the tensioning mechanism 29 acts a predetermined pulling force on the seventh link 27, to make the front cushion connection platform 30 on the seventh link 27 flush with the lying cushion connection platform 40 on the fourth link 24 in the vertical direction y.

Of course, in other embodiments, the front cushion connection platform 30 and the lying cushion connection platform 40 on the fourth link 24 may also have a slight inclination in the vertical direction y, namely, a certain angle may be formed between a line connecting the front cushion connection platform 30 and the lying cushion connection platform 40 and the vertical direction y. The included angle may be 5 degrees, 10 degrees, 15 degrees, or the like. When the mechanical linkage structure 20 is required to be in a semi-folding state, the third link 23, the fifth link 25, the sixth link 26, and the seventh link 27 are further rotated by rotating the fourth link 24. The fifth link 25 performs a predetermined trajectory movement under the action of the limit mechanism 28, and the seventh link 27 will not be pulled back to the folded state operated by the tensioning mechanism 29 with the limitation of the limit mechanism 28. As such, the mechanical linkage structure 20 is kept in a semi-folded state.

When the mechanical linkage structure 20 is required to be in a fully unfolded state, the fourth link 24 is continuously rotated to drive the third link 23, and the fifth link 25, the sixth link 26, and the seventh link 27 continues to rotate to a predetermined unfolded state, such that the front cushion connection platform 30 on the seventh link 27 and the lying cushion connection platform 40 on the fourth link 24 may be flush in a horizontal direction x.

Of course, in other embodiments, the front cushion connection platform 30 and the lying cushion connection platform 40 on the fourth link 24 may also have a slight inclination in the horizontal direction x, namely, a certain angle is existed between the line connecting the front cushion connection platform 30 and the lying cushion connection platform 40 and the horizontal direction x. The included angle may be 5 degrees, 10 degrees, 15 degrees, or the like.

It is understood that the horizontal direction x is defined as a direction substantially parallel to the ground. The vertical direction y is perpendicular to the horizontal direction x.

The limit mechanism 28 is disposed between the second link 22 and the fifth link 25. Specifically, the limit mechanism 28 includes an engaging portion 281 disposed on the second link 22 and a limiting slot 282 formed on the first end 251 of the fifth link 25. The engaging portion 281 is mounted in the limiting slot 282 to realize the connection between the second link 22 and the fifth link 25. The engaging portion 281 is movable along the limiting slot 282, so that when the fourth link 24 is rotated, the fifth link 25 performs a predetermined trajectory movement in the limiting slot 282 to unfold the seventh link 27.

Of course, in other embodiments, the position of the limiting slot 282 and the position of the engaging portion 281 may be interchanged. That is, the limiting slot 282 may be disposed on the second link 22, and the engaging portion 281 may be disposed on the fifth link 25. The engaging portion 281 is movable in the limiting slot 282 along a predetermined trajectory. The seventh link 27 may also be unfolded in this way.

It should be understood that the limit mechanism 28 may also implement the functions described above by using other structures.

In one embodiment, the limit mechanism 28 includes a slide rail disposed on the second link 22, and a slider disposed on the fifth link 25. The slider cooperates with the slide rail to be capable of sliding along the slide rail with a predetermined trajectory.

Furthermore, the tensioning mechanism 29 is disposed between the fifth link 25 and the seventh link 27. One end of the tensioning mechanism 29 is connected to the fifth link 25, and the other end is connected to the seventh link 27. The tensioning mechanism 29 is configured to generate a pulling force on the seventh link 27. When the mechanical linkage structure 20 is in the collapsed state, the front cushion connection platform 30 on the seventh link 27 and the lying cushion connection platform 40 on the fourth link 24 remain parallel in the vertical direction y. At the same time, during process of folding the mechanical linkage structure 20, the tensioning mechanism 29 is facilitated to a resetting of the seventh link 27.

Specifically, the tensioning mechanism 29 includes an elastic member 291 including a first end 291*a* and a second end 291*b* disposed opposite to each other, and the first end 291*a* of the elastic member is fixed to the fifth link 25. The second end 291*b* of the elastic member is fixed to the seventh link 27.

When the mechanical linkage structure 20 is in the collapsed state, the predetermined pulling force from the elastic member 291 pulls the seventh link 27. When the mechanical linkage structure 20 is in the semi-folding state, the elastic member 291 is partially stretched. When the mechanical linkage structure 20 is in the unfolded state, the elastic member 291 has the largest amount of stretch; at the same time, the front cushion connection platform 30 on the seventh link 27 and the lying cushion connection platform 40 on the fourth link 24 remains parallel in the horizontal direction x.

The elastic member 291 may be a spring or any elastic member made of elastic material. In this embodiment, the elastic member 291 is a spring.

Figure 8:
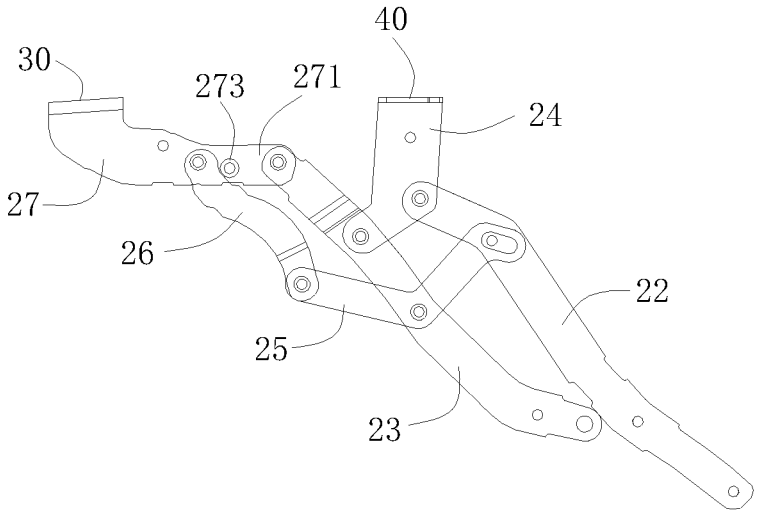
FIG. 8 is a schematic structural view of a limiting member provided in the present disclosure.

As shown in FIG. 8, in another embodiment, the seventh link 27 may be provided with a limiting member 273 for limiting the movement trajectory of the fourth link 24, the sixth link 26 and that of the seventh link 27.

It can be understood that when the mechanical linkage structure 20 is in the unfolded state (refer to FIG. 8), the limiting member 273 is disposed on the sixth link 26 and the seventh link to abut therebetween, to limit the movement of the sixth link 26, and further limit the movement of the fourth link 24. Therefore, the front cushion connection platform 30 on the seventh link 27 and the lying cushion connection platform 40 on the fourth link 24 may remain parallel in the horizontal direction x; or, by setting the position of the limiting member 273, the position of the front cushion connection platform 30 on the seventh link 27 may be slightly lower than the position of the lying cushion connection platform 40 on the fourth link 24.

Figure 9:
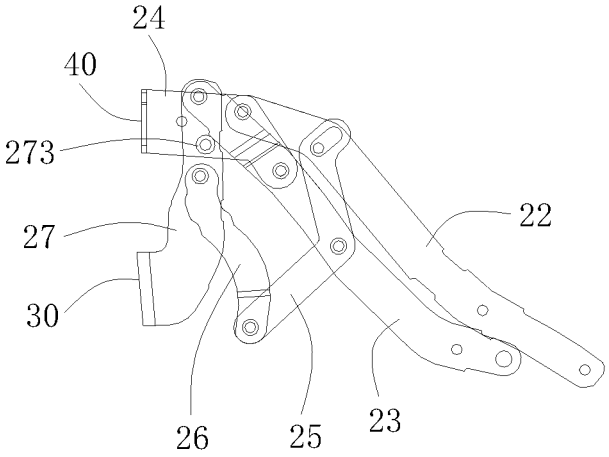
FIG. 9 is a schematic view of the limiting member of FIG. 8, when the mechanical linkage structure of FIG. 2 is in the folded state.

As shown in FIG. 9, when the mechanical linkage structure 20 is in the folded state, the limiting member 273 of the seventh link 27 abuts against the third link 23 to limit the movement of the seventh link 27 and the fourth link 24. As such, the front cushion connection platform 30 on the seventh link 27 and the lying cushion connection platform 40 on the fourth link 24 may remain parallel in the vertical direction y.

In other embodiments, the limiting member 273 may be replaced with the tensioning mechanism 29.

Further, in this embodiment, the limiting member 273 can be disposed adjacent to the first end 271 of the seventh link 27. In some embodiment, the limiting member 273 may be a stud or a protrusion.

The operation principle of the mechanical linkage structure 20 will be described as below:

When unfolding the mechanical linkage structure 20, the fourth link 24 is driven by a driving structure (not shown) to drive the first link 21, the second link 22, the third link 23, the fifth link 25, and the sixth link 26 move to perform an unfolding movement, thereby causing the seventh link 27 to be unfolded.

When folding the mechanical linkage structure 20, the fourth link 24 is driven by the driving structure (not shown) to drive the first link 21, the second link 22, the third link 23, the fifth link 25, and the sixth link 26 to move back and forth, to fold the seventh link 27.

The present disclosure also provides a chair including the frame 100. Specifically, the chair may be a deck chair, a couch, or the like.

The technical features of the above-described embodiments may be in any combination. For the sake of brevity of description, all possible combinations of the technical features in the above embodiments are not described. However, as long as there is no contradiction between the combinations of these technical features, all of the combinations should be considered as within the scope of this disclosure.

Although the devices have been described and illustrated using certain embodiments, however, the disclosure is not limited by the precise details set forth above. Many variations and modifications will be evident to those skilled in the art and may be made without departing from the spirit and scope of the disclosure.

What is claimed is:

1. A mechanical linkage structure for linking a chair and a seat, the mechanical linkage structure comprising a first link, a second link, and a third link respectively used as a driven link, a fourth link used as a driving link, a fifth link, a sixth link, and a seventh link respectively used as another driven link; wherein, the first link is pivotally connected to the second link and the third link, respectively;

the second link is pivotally connected to the fourth link and the fifth link, respectively;

the third link is pivotally connected to the fourth link, the fifth link, and the seventh link, respectively;

the fifth link is pivotally connected to the sixth link;

the sixth link is pivotally connected to the seventh link;

the fourth link is driven to rotate the first link, the second link, the third link, the fifth link, the sixth link and the seventh link, to realize unfold or collapse of the mechanical linkage structure, the first link, the second link, the third link, the fourth link, the fifth link, the sixth link and the seventh link respectively comprises a plurality of pivoting points thereon, which are used to realize direct pivotal connections between the first link, the second link, the third link, the fourth link, the fifth link, the sixth link, and the seventh link, the mechanical linkage structure further comprises a limit mechanism for restricting the movement of the fifth link, so that the seventh link moves along a predetermined trajectory while being collapsed or unfolded, wherein the limit mechanism comprises an engaging portion disposed on the second link, and a limiting slot disposed on the fifth link, the engaging portion is mounted in the limiting slot, and the engaging portion moves along the limiting slot during the collapse or unfolding of the mechanical linkage structure.

2. The mechanical linkage structure according to claim 1, wherein a lying cushion connection platform is disposed on the fourth link, and a front cushion connection platform is disposed on the seventh link;

when the mechanical linkage structure is unfolded, the front cushion connection platform is flush with the lying cushion connection platform in a horizontal direction;

when the mechanical linkage structure is folded, the front cushion connection platform is flush with the lying cushion connection platform in a vertical direction.

3. The mechanical linkage structure according to claim 1, wherein the fourth link is V-shaped, L-shaped, or arc shaped.

4. The mechanical linkage structure according to claim 1, wherein the mechanical linkage structure further comprises a tensioning mechanism configured to make the lying cushion connection platform and the front cushion connection platform flush with each other in a vertical direction when the mechanical linkage structure is in a collapsed state.

5. The mechanical linkage structure according to claim 4, wherein the tensioning mechanism comprises an elastic member, one end of the elastic member is connected to the fifth link, and the other end of the elastic member is connected to the seventh link.

6. The mechanical linkage structure according to claim 1, wherein a limiting member is disposed on the seventh link and configured to limit the movement trajectory of the fourth link, the sixth link, and the seventh link.

7. A frame, comprising a fixing assembly, a movable link assembly coupled to the fixing assembly, and a mechanical linkage structure pivotally connected to the movable link assembly, wherein the mechanical linkage structure comprises a first link, a second link, and a third link respectively used as a driven link, a fourth link used as a driving link, a fifth link, a sixth link, and a seventh link respectively used as another driven link; the first link is pivotally connected to the second link and the third link, respectively; the second link is pivotally connected to the fourth link and the fifth link, respectively; the third link is pivotally connected to the fourth link, the fifth link, and the seventh link, respectively; the fifth link is pivotally connected to the sixth link; the sixth link is pivotally connected to the seventh link; the fourth link is driven to rotate the first link, the second link, the third link, the fifth link, the sixth link and the seventh link, to realize the unfolding or collapse of the mechanical linkage structure, the first link, the second link, the third link, the fourth link, the fifth link, the sixth link and the seventh link respectively comprises a plurality of pivoting points thereon, which are used to realize direct pivotal connections between the first link, the second link, the third link, the fourth link, the fifth link, the sixth link, and the seventh link, the mechanical linkage structure further comprises a limit mechanism for restricting the movement of the fifth link, so that the seventh link moves along a predetermined trajectory while being collapsed or unfolded, wherein the limit mechanism comprises an engaging portion disposed on the second link, and a limiting slot disposed on the fifth link, the engaging portion is mounted in the limiting slot, and the engaging portion moves along the limiting slot during the collapse or unfolding of the mechanical linkage structure.

8. The frame according to claim 7, wherein a lying cushion connection platform is disposed on the fourth link, and a front cushion connection platform is disposed on the seventh link;

when the mechanical linkage structure is unfolded, the front cushion connection platform is flush with the lying cushion connection platform in a horizontal direction;

when the mechanical linkage structure is folded, the front cushion connection platform is flush with the lying cushion connection platform in a vertical direction.

9. The frame according to claim 7, wherein the fourth link is V-shaped, L-shaped, or arc shaped.

10. The frame according to claim 7, wherein the mechanical linkage structure further comprises a tensioning mechanism configured to make the lying cushion connection platform and the front cushion connection platform flush with each other in a vertical direction when the mechanical linkage structure is in a collapsed state.

11. The frame according to claim 10, wherein the tensioning mechanism comprises an elastic member, one end of the elastic member is connected to the fifth link, and the other end of the elastic member is connected to the seventh link.

12. A chair, comprising a frame comprising a fixing assembly, a movable link assembly coupled to the fixing assembly, and a mechanical linkage structure pivotally connected to the movable link assembly, wherein the mechanical linkage structure comprises a first link, a second link, and a third link respectively used as a driven link, a fourth link used as a driving link, a fifth link, a sixth link, and a seventh link respectively used as another driven link; the first link is pivotally connected to the second link and the third link, respectively; the second link is pivotally connected to the fourth link and the fifth link, respectively; the third link is pivotally connected to the fourth link, the fifth link, and the seventh link, respectively; the fifth link is pivotally connected to the sixth link; the sixth link is pivotally connected to the seventh link; the fourth link is driven to rotate the first link, the second link, the third link, the fifth link, the sixth link and the seventh link, to realize the unfolding or collapse of the mechanical linkage structure, the first link, the second link, the third link, the fourth link, the fifth link, the sixth link and the seventh link respectively comprises a plurality of pivoting points thereon, which are used to realize direct pivotal connections between the first link, the second link, the third link, the fourth link, the fifth link, the sixth link, and the seventh link, the mechanical linkage structure further comprises a limit mechanism for restricting the movement of the fifth link, so that the seventh link moves along a predetermined trajectory while being collapsed or unfolded, wherein the limit mechanism comprises an engaging portion disposed on the second link, and a limiting slot disposed on the fifth link, the engaging portion is mounted in the limiting slot, and the engaging portion moves along the limiting slot during the collapse or unfolding of the mechanical linkage structure.

* * * * *